US007052181B2

(12) United States Patent
Smith et al.

(10) Patent No.: US 7,052,181 B2
(45) Date of Patent: May 30, 2006

(54) ZIPPERED BAG HAVING A PAIR OF FASTENER STRIPS

(75) Inventors: Leland J. Smith, Midland, MI (US); Rui M. Pires, Midland, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 295 days.

(21) Appl. No.: 10/458,316

(22) Filed: Jun. 11, 2003

(65) Prior Publication Data

US 2004/0252916 A1 Dec. 16, 2004

(51) Int. Cl.
*B65D 33/16* (2006.01)

(52) U.S. Cl. ..... 383/64; 383/59; 24/400; 24/585.12

(58) Field of Classification Search ..... 383/64, 383/59; 24/399–400, 585.12
See application file for complete search history.

(56) References Cited

U.S. PATENT DOCUMENTS

| | | | | |
|---|---|---|---|---|
| 2,287,349 A | | 6/1942 | Hisrsch | |
| 2,606,352 A | | 8/1952 | Hermann | |
| 2,848,031 A | | 8/1958 | Svec | |
| 3,054,434 A | | 9/1962 | Ausnit | |
| 3,103,049 A | | 9/1963 | Hawley | |
| 3,115,689 A | * | 12/1963 | Jacobs | 24/399 |
| 3,122,807 A | | 3/1964 | Ausnit | |
| 3,173,184 A | | 3/1965 | Ausnit | |
| 3,213,504 A | * | 10/1965 | Ausnit | 24/399 |
| 3,220,076 A | | 11/1965 | Ausnit | |
| 3,226,787 A | | 1/1966 | Ausnit | |
| 3,230,593 A | * | 1/1966 | Marcel | 24/399 |
| 3,239,904 A | * | 3/1966 | Ausnit | 24/427 |
| 3,259,951 A | | 7/1966 | Zimmerman | |

(Continued)

FOREIGN PATENT DOCUMENTS

DE 12 70 313 6/1968

(Continued)

OTHER PUBLICATIONS

International Search Report and Written Opinion dated Nov. 11, 2004, Appl. No. PCT/US2004/018886.

(Continued)

*Primary Examiner*—Jes F. Pascua

(57) ABSTRACT

A zippered bag includes two sheets sealed to each other along a plurality of edges to form opposing bag sides. The bag also includes a first fastener strip including an inner wall and an outer wall hinged to the inner wall, with the first fastener strip being attached to one of the opposing bag sides. The inner wall includes a first profile. A second fastener strip includes a second profile, the second fastener strip being attached to the other one of the opposing bag sides. The first and second profiles are adapted to interlock to close the bag, wherein the first and second profiles each include an uppermost closure element, an intermediate closure element, and a bottommost closure element. A slider straddles the first and second fastener strips such that the uppermost, intermediate, and bottommost closure elements are enclosed by the slider and the slider is movable between a closed position and an open position. The slider includes a separator leg disposed between the first and second profiles, with the separator leg extending down from a top surface of the slider. The separator leg extends through the uppermost and intermediate closure elements such that the bottommost closure elements remain in contact under the separator leg when the slider is moved into the closed position, but the bottommost closure elements are opened by the slider when moved into the open position.

13 Claims, 4 Drawing Sheets

U.S. PATENT DOCUMENTS 3,324,520 A * 6/1967 Ausnit ..... 24/399
3,381,592 A 5/1968 Ravel
3,430,329 A * 3/1969 Ausnit ..... 29/408
3,532,571 A 10/1970 Ausnit
3,579,747 A 5/1971 Hawley
3,660,875 A 5/1972 Gutman
3,713,923 A 1/1973 Laguern
3,790,992 A 2/1974 Herz
3,806,998 A 4/1974 Laguerre
4,003,972 A 1/1977 Herz
4,262,395 A 4/1981 Kosky
4,555,282 A 11/1985 Yano
4,578,813 A 3/1986 Ausnit
4,747,702 A 5/1988 Scheibner
4,825,514 A 5/1989 Akeno
4,863,286 A 9/1989 Branson
4,878,763 A 11/1989 Ausnit
4,925,318 A 5/1990 Sorensen
5,007,142 A 4/1991 Herrington
5,007,143 A 4/1991 Herrington
5,010,627 A 4/1991 Herrington
5,017,021 A 5/1991 Simonsen et al.
5,020,194 A 6/1991 Herrington
5,063,644 A 11/1991 Herrington
5,067,208 A 11/1991 Herrington, Jr. et al.
5,070,583 A 12/1991 Herrington
5,140,727 A 8/1992 Dais et al.
5,152,613 A 10/1992 Herrington, Jr.
5,161,286 A 11/1992 Herrington, Jr.
5,189,764 A 3/1993 Herrington et al.
5,272,794 A 12/1993 Hamatani et al.
5,283,932 A 2/1994 Richardson et al.
5,301,395 A 4/1994 Richardson et al.
5,442,837 A 8/1995 Morgan
5,442,838 A 8/1995 Richardson et al.
5,664,299 A 9/1997 Porchia et al.
5,829,884 A 11/1998 Yeager
5,953,796 A 9/1999 McMahon et al.
5,956,815 A 9/1999 O'Connor et al.
6,047,450 A 4/2000 Machacek et al.
6,088,887 A 7/2000 Bois
6,186,796 B1 2/2001 Wedge
6,220,754 B1 4/2001 Stiglic et al.
6,286,191 B1 9/2001 Van Erden
6,287,001 B1 9/2001 Buchman
6,305,844 B1 10/2001 Bois
D451,378 S 12/2001 Kinigakis et al.
6,357,914 B1 3/2002 Kinigakis et al.
6,378,177 B1 4/2002 Athans et al.
6,386,760 B1 5/2002 Tomic
6,402,375 B1 6/2002 Schreiter et al.
6,419,391 B1 7/2002 Thomas
6,438,926 B1 8/2002 Thieman
6,439,770 B1 8/2002 Catchman
6,439,771 B1 8/2002 Herrington
6,461,042 B1 10/2002 Tomic et al.
6,467,956 B1 10/2002 Tilman et al.
6,481,890 B1 11/2002 VandenHeuvel
D467,170 S 12/2002 Kinigakis et al.
6,491,432 B1 12/2002 May
6,499,272 B1 12/2002 Thieman
6,510,595 B1 1/2003 Matsushima et al.
6,517,242 B1 2/2003 Buchman
6,524,002 B1 2/2003 Tomic
6,526,632 B1 3/2003 Blythe et al.
6,571,430 B1 6/2003 Savicki et al.
6,575,625 B1 6/2003 Cappel et al.
6,575,628 B1 6/2003 Borchardt et al.
6,581,249 B1 6/2003 Savicki et al.
6,595,689 B1 7/2003 Borchardt et al.
6,601,370 B1 8/2003 Colombo et al.
6,609,827 B1 8/2003 Bois et al.
6,611,996 B1 9/2003 Blythe et al.
6,616,333 B1 9/2003 Kinigakis et al.
6,622,353 B1 9/2003 Provan et al.
D480,988 S 10/2003 Buchman
6,632,021 B1 10/2003 Bois et al.
6,662,410 B1 12/2003 Kolovich et al.
6,663,283 B1 12/2003 Cappel
6,666,580 B1 12/2003 Bois
6,675,558 B1 1/2004 Kinigakis et al.
6,679,027 B1 1/2004 Schreiter
6,686,005 B1 2/2004 White et al.
6,688,079 B1 2/2004 Kinigakis et al.
6,688,080 B1 2/2004 Kinigakis et al.
6,712,509 B1 3/2004 Cappel
6,712,510 B1 3/2004 Schneider et al.
6,713,152 B1 3/2004 Chen et al.
6,721,999 B1 4/2004 Meager
6,733,178 B1 5/2004 Bois
6,733,622 B1 5/2004 McMahon et al.
6,739,755 B1 5/2004 Schreiter
6,743,330 B1 6/2004 Crevier
6,755,569 B1 6/2004 Bois
6,761,481 B1 7/2004 Bois
6,769,229 B1 8/2004 Kinigakis et al.
6,786,641 B1 9/2004 Plourde
6,826,808 B1 * 12/2004 Kutschka ..... 24/427
2002/0034344 A1 3/2002 Bois
2003/0077009 A1 4/2003 Schreiter
2003/0219174 A1 11/2003 Piechocki
2003/0219176 A1 11/2003 Kocher et al.
2003/0223654 A1 12/2003 Gerrits
2004/0001650 A1 1/2004 Piechocki et al.
2004/0050017 A1 3/2004 Thomas
2004/0055255 A1 3/2004 Knight
2004/0066985 A1 4/2004 Patel
2004/0066986 A1 4/2004 Erlick
2004/0081375 A1 4/2004 Pokusa
2004/0086206 A1 5/2004 Tomic

FOREIGN PATENT DOCUMENTS

WO WO 00/76342 12/2000
WO WO 03/080457 10/2003

OTHER PUBLICATIONS

International Search Report and Written Opinion dated Nov. 11, 2004, Appl. No. PCT/US2004/018886.

* cited by examiner

ZIPPERED BAG HAVING A PAIR OF FASTENER STRIPS

BACKGROUND OF THE INVENTION

1. Field of the Invention

The present invention relates to zippered bags having a pair of interlocking profiles each including a plurality of closure elements.

2. Description of the Background of the Invention

Reclosable fastener assemblies are useful for sealing thermoplastic bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations. For example, U.S. Pat. No. 5,140,727 describes interlocking rib and groove elements, whereas U.S. Pat. No. 5,007,143 describes a rolling action zipper profile and U.S. Pat. No. 4,747,702 describes profiles that are U-shaped with interlocking hooks.

The sliders for opening or closing the reclosable fasteners are generally shaped so that the slider straddles the profiles. The sliders often include a separating element that is inserted through the profiles in order to open the fastener. Such a slider is described in U.S. Pat. Nos. 5,067,208 and 5,664,299, each of which is incorporated herein by reference. In other types of sliders, the separating element does not penetrate the profiles, but rather, slides above the profiles on a specially adapted track located above the profiles, as described in U.S. Pat. No. 5,007,143. The separating elements may have various shapes, such as a V-shaped separating element, as disclosed in U.S. Pat. No. 3,173,184, or a tapered separating element with a circular end, as disclosed in U.S. Pat. No. 5,067,208.

A disadvantage of some of the known fastener assemblies is that thermoplastic bags incorporating the fastener assemblies may leak. Leaking is a problem especially in some fastener assemblies using a slider having a separating element for opening the fastener. In these fastener assemblies, the fastener assembly may leak even when the slider is in a closed position because the separating element creates a fluid path through the profiles.

Accordingly, there is a need in the art for a zippered bag using a slider that will not create a fluid path through the profiles that make up a fastener assembly.

SUMMARY OF THE INVENTION

In accordance with one aspect of the present invention a zippered bag includes two sheets sealed to each other along a plurality of edges to form opposing bag sides. The bag also includes a first fastener strip including an inner wall and an outer wall hinged to the inner wall, with the first fastener strip being attached to one of the opposing bag sides. The inner wall includes a first profile. A second fastener strip includes a second profile, the second fastener strip being attached to the other one of the opposing bag sides. The first and second profiles are adapted to interlock to close the bag. The first and second profiles each include an uppermost closure element, an intermediate closure element, and a bottommost closure element. A slider straddles the first and second fastener strips such that the uppermost, intermediate, and bottommost closure elements are enclosed by the slider and the slider is movable between a closed position and an open position. The slider includes a separator leg disposed between the first and second profiles, with the separator leg extending down from a top surface of the slider. The separator leg extends through the uppermost and intermediate closure elements such that the bottommost closure elements remain in contact under the separator leg when the slider is moved into the closed position, but the bottommost closure elements are opened by the slider when moved into the open position.

In accordance with another aspect of the present invention, a zippered bag includes two sheets sealed to each other along edges thereof to form opposing bag sides. The bag includes a first fastener strip having an inner wall and an outer wall hinged to the inner wall, wherein the first fastener strip is attached to one of the opposing bag sides and the inner wall includes a first profile. The bag further includes a second fastener strip having a second profile, wherein the second fastener strip is attached to the other of the opposing bag sides and the first and second profiles are adapted to interlock to close the bag. A slider straddles the first and second fastener strips such that the slider is movable between a closed position and an open position, wherein the slider includes a separator leg disposed between the first and second profiles. The first and second profiles each include an uppermost closure element, an intermediate closure element, and a bottommost closure element. The bottommost closure element of the first profile includes an L shape and the bottommost closure element of the second profile includes a hook shape, wherein the bottommost closure elements contact along substantially their entire lengths when the slider is in the closed position.

In accordance with yet another aspect of the present invention, a zippered bag includes two sheets sealed to each other along a plurality of edges to form opposing bag sides. The bag further includes a first fastener strip having a first profile with a closure element having a hook shape with an L-shaped distal end extending from the hook shape, wherein the first fastener strip is attached to one of the opposing bag sides. The bag further includes a second fastener strip including a second profile having a closure element with a hook shape, wherein the second fastener profile is attached to the other one of the opposing bag sides. The closure elements of the first profile and the closure elements of the second profile are adapted to interlock to close the bag. A slider straddles the first and second fastener strips such that the slider is movable between a closed position and an open position, wherein the slider includes a separator leg disposed between the first and second profiles. The slider is adapted to separate the first and second profiles when the slider is moved from the closed position to the open position. Each of the first profile and the second profile each includes an upper closure element disposed above the L-shaped closure element and the closure element having a hook shape. The L-shaped closure element and the closure element having a hook shape contact over a larger area than the upper closure elements.

DESCRIPTION OF THE PREFERRED EMBODIMENTS

Figure 1:
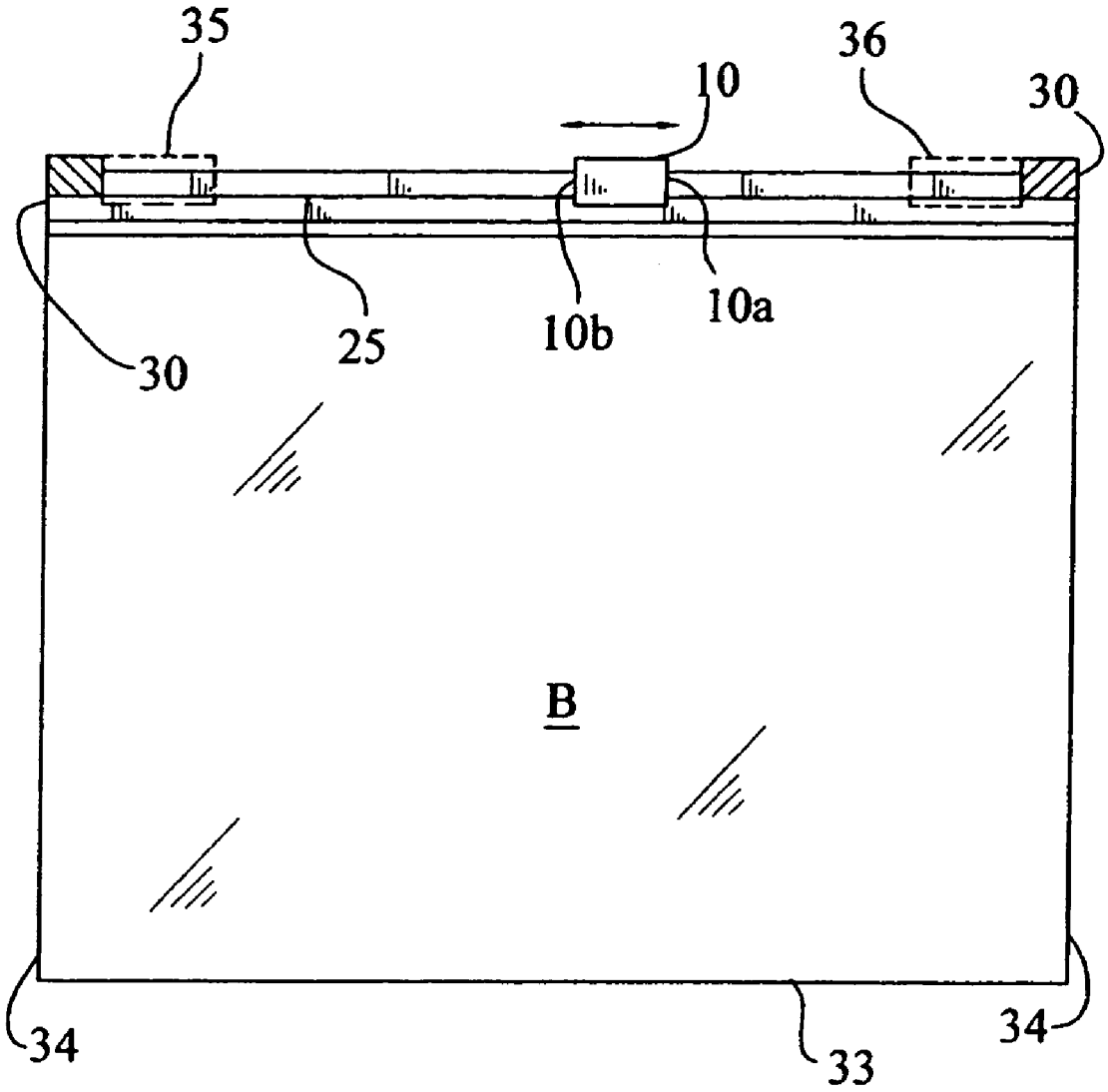
FIG. 1 is a plan view of a thermoplastic bag having a fastener assembly including a slider according to the present invention.

FIG. 1 shows a reclosable thermoplastic bag B, a profiled plastic, reclosable fastener and a slider 10, embodying the present invention. The bag B includes a bottom 33 and two opposing, sealed edges 34. The bag B may be made from any suitable thermoplastic film such as, for example, low density polyethylene, linear low density polyethylene, substantially linear copolymers of ethylene and a C3–C8 α-olefin, polypropylene, polyvinylidene chloride, mixtures of two or more of these polymers, or mixtures of one of these polymers with another thermoplastic polymer.

Figure 2:
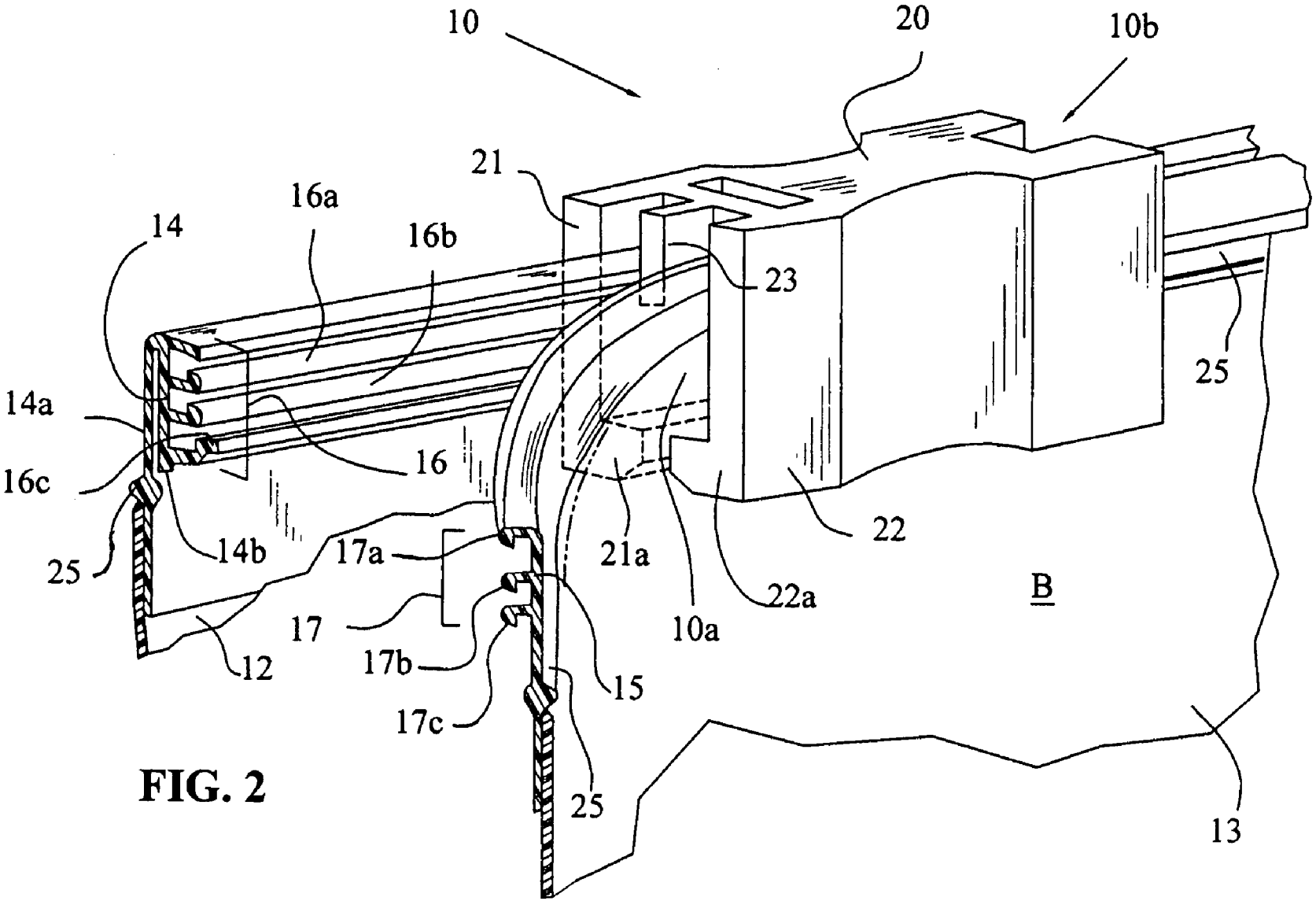
FIG. 2 is a perspective view of a reclosable thermoplastic bag with a fastener assembly according to the present invention.

As shown in FIG. 2, the bag B comprises a pair of flexible, plastic sheets 12 and 13. A first fastener strip 14 is attached to a top of the sheet 12 and a second fastener strip 15 is attached to the top of the sheet 13. As will be discussed in more detail below, the slider 10 straddles the first and second fastener strips 14, 15 and slides along the fastener strips 14, 15 to open and close the bag B.

As shown in FIGS. 2–5, the first fastener strip 14 includes an outer wall 14*a* and an inner wall 14*b*. An outer surface of the outer wall 14*a* is attached to the top edge of the sheet 12 of the bag B. As shown in FIG. 2, the second fastener strip 15 is attached by its outer surface to a top edge of the sheet 13. The strips 14 and 15 may be extruded separately and attached to the respective sides of the bag mouth or the strips 14 and 15 may be extruded integrally with the sides of the bag mouth. At either end, the fastener strips 14, 15 are fused to the bag B to form end stops 30.

Figure 3:
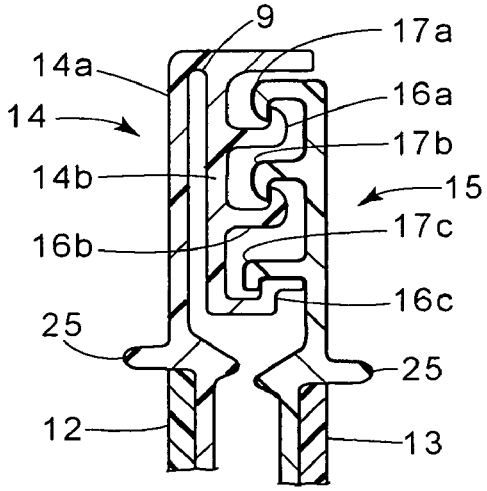
FIG. 3 is a partial cross-sectional view of interlocking fastener strips of the present invention.
Figure 4:
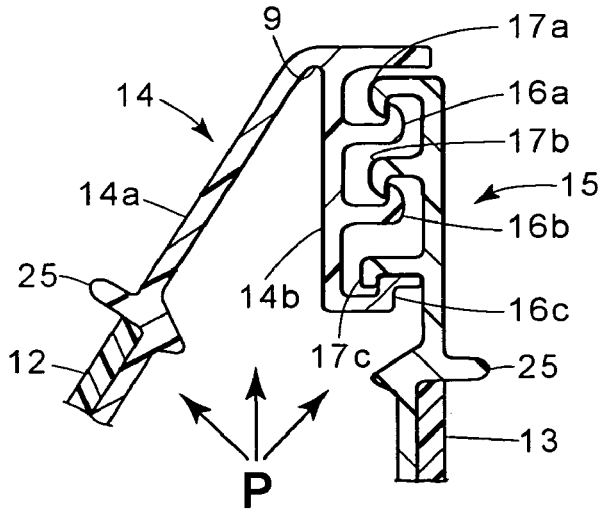
FIG. 4 is a partial cross-sectional view of a hinge on one of the fastener strips shown in FIG. 3.
Figure 5:
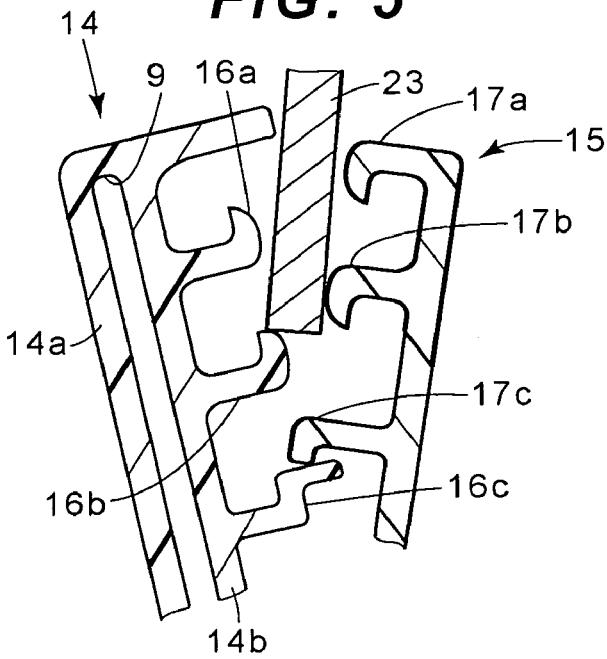
FIG. 5 is a partial cross-sectional view of a separator leg of the slider separating the fastener strips when the slider is in a closed position.

As shown in FIGS. 3–5, the fastener strip 14 includes a hinge 9, which allows the outer wall 14*a* to pivot away from the inner wall 14*b*. As shown in FIG. 4, the bag sheet 12 is attached to the outer wall 14*a* such that any force acting on the sheet 12 causes the outer wall 14*a* to pivot about the hinge 9, as will be discussed in more detail below.

A first profile 16 extends along the inner surface of the first fastener strip 14. As shown in FIGS. 2–5, the first profile 16 has at least an uppermost closure element 16*a*, an intermediate closure element 16*b* and a bottommost closure element 16*c*. The closure elements 16*a*–16*c* project laterally from the inner surface 14*b* of the strip 14. Likewise, the second profile 17 has at least an uppermost closure element 17*a*, an intermediate closure element 17*b* and a bottommost closure element 17*c*. The closure elements 17*a*–17*c* project laterally from the inner surface of strip 15. When the bag is closed, the closure elements 16*a*–16*c* of profile 16 interlock with the corresponding closure elements 17*a*–17*c* of profile 17. As shown in FIGS. 2–5, closure elements 16*a*, 16*b*, 17*a*, 17*b* have hooks on the ends of the closure elements, so that the profiles remain interlocked when the bag is closed, thereby forming a seal. The seal advantageously is such that under normal conditions of use, it forms a barrier to liquids.

As shown in FIG. 3, the bottommost closure elements 16*c* and 17*c* perferably nestle and contact over a larger area than any one pair of the other closure elements 16*a*, 17*a*, 16*b*, 17*b*. This larger contact area is the result of the shapes of the bottommost closure elements 16*c*, 17*c*. The bottommost closure element 16*c* of the first profile 16 is preferably formed in a hook shape, like the other closure elements, but with the addition of a perpendicularly extending extension to create a generally L-shaped distal end. Preferably, substantially the entire long side of the L-shaped distal end of the bottommost closure element 16*c* contacts the bottommost closure element 17*c* of the second profile 17. When the bag is closed, the nestling between the bottommost closure elements 16*c*, 17*c* advantageously, under normal conditions of use, forms a barrier to liquids.

The profiles 16 and 17 can each have more than three closure elements, so that any number of closure elements can be disposed between the uppermost and bottommost closure elements. In addition, the profiles 16, 17 may have fewer than three closure elements, such that only uppermost closure elements 16*a*, 17*a* and bottommost closure elements 16*c*, 17*c* are provided, or only the intermediate closure elements 16*b*, 17*b* and the bottommost closure elements 16*c*, 17*c* are provided.

The closure elements can be any shape, such as a rib and groove shape as described in U.S. Pat. No. 5,140,727, or an angled hook shape, as described in U.S. Pat. No. 4,747,702. Nevertheless, the preferred number of closure elements and the preferred shape of those closure elements are those shown in the figures.

The operation of the closure elements 16*a*–16*c*, 17*a*–17*c* is improved by the presence of the hinge 9, as shown in FIG. 4. Because of the hinge 9, a pressure P within the bag will cause the outer wall 14*a* to pivot as the pressure acts on the outer wall 14*a*, but will not cause the closure elements 16*a*–16*c*, 17*a*–17*c* to separate. Indeed, the pressure P may even serve to force the closure elements 16*a*–16*c*, 17*a*–17*c* closer together, thus strengthening the interlock between the closure elements 16*a*–16*c*, 17*a*–17*c*. Accordingly, as a result of the hinge 9, the so-called "burst strength" of the fastener assembly is substantially increased over fastener assemblies that do not have a hinged member.

As shown in FIGS. 1 and 2, the slider 10 is configured to move between a closed position 35, where it is prevented from further movement by one end stop 30, and an open position 36, where it is prevented from further movement by another end stop 30. Thus, when the slider 10 reaches the closed position 35 at one end of the fastener strips 14, 15, the bag B is closed, and the profiles 16, 17 are interlocked throughout substantially their entire lengths. When the slider 10 reaches the open position 36 at the opposite end of the fastener strips 14, 15, the bag B is open and the profiles 16, 17 are disengaged throughout their lengths.

Referring now to FIG. 2, the slider 10 comprises an inverted, U-shaped member having a top 20 for moving along the top edges of the fastener strips 14 and 15. The slider 10 has side walls 21, 22 depending from the top 20. The side walls 21, 22 extend downward along the outer surface of the fastener strips 14, 15, to a point at or below the profiles 16, 17, so that at least a portion of the profiles 16, 17 are held between the side walls 21, 22. The side walls 21, 22 cooperate with the fastener strips 14, 15 so that, as the slider moves between the open position 36 and the closed position 35, the fastener strips 14, 15 are received between the side walls 21, 22.

Figure 6:
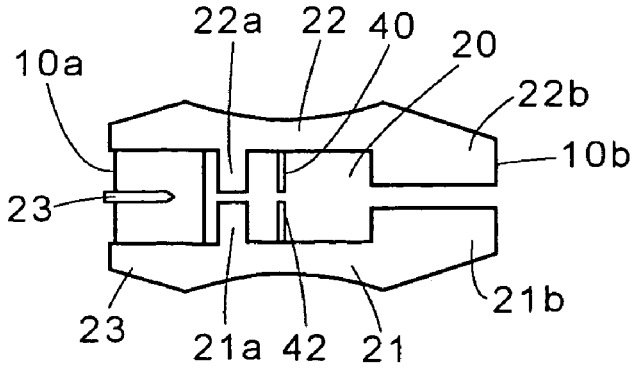
FIG. 6 is a bottom plan view of a slider according to the present invention.

As shown in FIG. 6, the side walls 21, 22 extend from a separating end 10*a* of the slider to a pinching end 10*b* of the slider 10. The side walls 21, 22 include pinching elements 40, 42, which pinch, or squeeze, the fastener strips together, thereby forcing the profiles 16 and 17 (not shown in FIG. 5) into an interlocked relationship.

As shown in FIGS. 2, 5 and 6, a separating leg 23 depends from the top 20 of the slider 10 between the side walls 21, 22 and the fastener strips 14, 15. As shown, the separating leg 23 is positioned at the separating end 10*a* of the slider 10, although the separating leg 23 can be positioned anywhere along the top.

As shown in FIG. 5, the separating leg 23 does not extend all the way through the profiles 16 and 17. Rather, the separating leg 23 extends between the uppermost closure elements 16*a* and 17*a* and the intermediate closure elements 16*b* and 17*b*, but does not extend far enough to reach between the bottommost closure elements 16*c* and 17*c*.

As shown in FIGS. 1 and 2, when the slider 10 is moved toward the open position 36, the pinching end 10*b* of the slider leads, and the separating end 10*a* of the slider trails, so that the separating leg 23 disengages the profiles 16 and 17. When the slider 10 is moved toward the closed position 35, the separating end 10*a* leads and the pinching end 10*b* trails, so that the pinching elements 40, 42 squeeze the profiles together into engagement. The separator leg 23 is always disposed between the fastener strips 14, 15, even when the slider 10 is in the closed position 35, as shown in FIG. 5.

To prevent the separator leg 23 from creating a fluid path from the inside of the bag to the outside when the slider is in the closed position, the present invention provides the bottommost closure elements 16*c*, 17*c*. FIG. 5 is a partial cross-sectional view showing the fastener strips 14, 15 when the slider 10 is in the closed position 35. In this position, the bottommost closure elements 16*c*, 17*c* remain in contact with each other even though the uppermost and intermediate closure elements are separated by the separator leg 23. When the slider 10 is in the closed position 35, the long end of the L-shaped extension of the bottommost closure element 16*c* contacts the hook of the bottommost closure element 17*c*, although other portions of the respective closure elements 16*c*, 17*c* may contact.

Although the bottommost closure elements 16*c*, 17*c* remain in contact with each other when the separator leg 23 is disposed between the uppermost and intermediate closure elements 16*a*, 17*a*, 16*b*, 17*b* and the slider 10 is in the closed position 35, the bottommost closure elements 16*c*, 17*c* nevertheless will separate when the slider 10 is moved towards the open position 36. Part of the reason for this is the end stop 30 disposed near the closed position 35. At the end stops 30, the fastener strips 14, 15 are fused to each other and to the bag B. Therefore, even when the separator leg 23 wedges the profiles 16, 17 apart, the end stop 30 prevents the profiles 16, 17 from separating to any significant degree when the slider 10 is in the closed position 35. Thus, the separator leg 23 (when the slider 10 is in the closed position 35), by interference, separates the uppermost and intermediate closure elements 16*a*, 17*a*, 16*b*, 17*b*, but because the end stop 30 prevents the fastener strips 14, 15 from moving apart, the bottommost closure elements 16*c*, 17*c* remain in contact.

However, as the slider 10 is moved from the closed position 35 towards the open position 36, the separator leg 23 wedges the fastener strips 14, 15 far enough apart to separate the bottommost closure elements 16*c*, 17*c*. Accordingly, a user can completely open the bag by simply moving the slider 10 from the closed position 35 to the open position 36.

Figure 7:
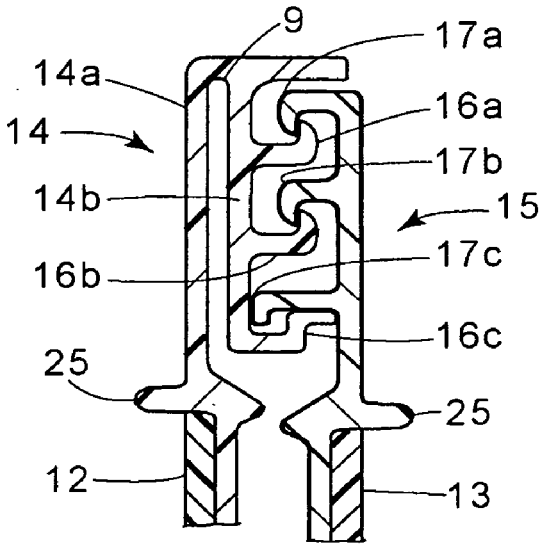
FIG. 7 is a partial cross-sectional view of interlocking fastener strips in a variation of those shown in FIG. 3.
Figure 8:
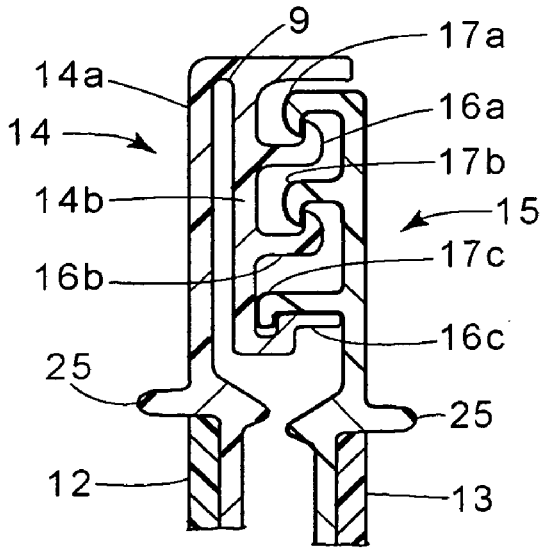
FIG. 8 is a partial cross-sectional view of interlocking fastener strips in a variation of those shown in FIG. 7.

In an alternative configuration, shown in FIG. 7, the bottommost closure 17*c* element is longer than the uppermost and intermediate closure elements 17*a*, 17*b*, such that the bottommost closure element 17*c* touches the inner wall 14*b* of the first fastener strip 14. In this configuration, when the slider 10 is in the closed position and the separator leg 23 is disposed between the uppermost and intermediate closure elements 16*a*, 17*a*, 16*b*, 17*b*, the bottommost closure element 16*c* will contact the stem of the bottommost closure element 17*c*, rather than the hook as shown in FIG. 5. In yet another alternative configuration of the configuration shown in FIG. 7, the L-shaped distal end of the bottommost closure element 16*c* is made longer to the same degree that the stem of the bottommost closure element 17*c* is made longer, as shown in FIG. 8.

The slider 10 optionally includes means for securing the slider 10 to the fastener strips 14, 15. As shown in FIGS. 2 and 6, the means includes ridges 25 on the outer surfaces of the fastener strips 14, 15 and shoulders 21*a*, 22*a*, 21*b*, 22*b* on the side walls 21, 22 of the slider 10. The shoulders 21*a*, 22*a* project inwardly from the depending side walls at the separating end 10*a* of the slider, while the shoulders 21*b*, 22*b* project inwardly from the depending side walls at the pinching end 10*b* of the slider. The shoulders 21*a*, 22*a*, 21*b*, 22*b* project inwardly at a point at or below the profiles 16 and 17 and grasp the lower surfaces of the ridges 25. The ridges 25 thus act as handles for the slider 10 to hold onto, such that the slider 10 maintains the straddling relation with the fastener strips 14, 15 and does not fall off the bag B. The shoulders 21*a*, 22*a*, 21*b*, 22*b* can be continuous along the entire length of the slider 10, if desired, in order to maximize the security to the bag B.

The ridges 25 extend along the length of the outer surface of fastener strips 14 and 15 at a point at or below the profiles, and can be connected to the fastener strips 14, 15 by any desired means, such as, for example, by extruding with the fastener strips 14, 15, heating, gluing, or snapping in place. The ridges 25 can also result from the difference in thicknesses between the fastener strips 14, 15 and the sheets 12, 13 of the bag B.

The bag of the present invention can be made using methods well known in the art, such as, for example, by blow or cast extrusion. The slider can be attached to the fastener strips using methods such as causing reciprocal movements of the clasp using a tool, as described in U.S. Pat. No. 4,262,395, through a hinge structure which attaches wings to the body of the slider, as described in U.S. Pat. No. 5,067,208, through a rigidizing structure as described in U.S. Pat. No. 5,283,932, or through in-place assembly.

While the present invention has been described with respect to what are at present considered to be the preferred embodiments, it should be understood that the invention is not limited to the disclosed embodiments. To the contrary, as exemplified above, the invention is intended to cover various modifications and equivalent arrangements included within the spirit and scope of the appended claims. Therefore, the scope of the following claims is intended to be accorded the broadest reasonable interpretation so as to encompass all such modifications and equivalent structures and functions.

INDUSTRIAL APPLICABILITY

The zippered bag according to the present invention provides a hinged fastener that increases burst strength. In addition, the zippered bag according to the present invention includes a slider having a separator leg that partially extends between closure elements. The zippered bag is leak resistant even when the slider is in the closed position and the separator leg partially extends between the closure elements.

We claim:

1. A zippered bag comprising two sheets sealed to each other along a plurality of edges to form opposing bag sides, said bag comprising:

a first fastener strip including an inner wall and an outer wall hinged to the inner wall, said first fastener strip being attached to one of the opposing bag sides, said inner wall including a first profile;

a second fastener strip including a second profile, said second fastener strip being attached to the other one of the opposing bag sides, said first and second profiles being adapted to interlock to close said bag, wherein the first and second profiles each include an uppermost closure element, an intermediate closure element, and a bottommost closure element; and a slider straddling said first and second fastener strips such that the uppermost, intermediate, and bottommost closure elements are enclosed by said slider and said slider is movable between a closed position and an open position, said slider including a separator leg disposed between said first and second profiles, said separator leg extending down from a top surface of said slider, wherein the separator leg extends through the uppermost and intermediate closure elements such that the bottommost closure elements remain in contact under the separator leg when the slider is moved into the closed position, but the bottommost closure elements are opened by the slider when moved into the open position.

2. A zippered bag according to claim 1, wherein said first and second profiles each includes at least one closure element, with said closure element of said first profile including an L-shaped distal end and said closure element of said second profile having a hook shape, wherein said closure elements contact when said slider is in the closed position.

3. A zippered bag according to claim 1, wherein said slider includes side walls extending from the top surface of said slider and shoulders extending inwardly from said side walls, said side walls and said shoulders holding said slider onto said bag.

4. A zippered bag according to claim 1, wherein said inner wall and said outer wall of said first fastener strip extend substantially parallel to each other and are joined at a hinged portion disposed between them.

5. A zippered bag comprising two sheets sealed to each other along edges thereof to form opposing bag sides, said bag comprising:

a first fastener strip including an inner wall and an outer wall hinged to the inner wall, said first fastener strip being attached to one of the opposing bag sides, said inner wall including a first profile;

a second fastener strip including a second profile, said second fastener strip being attached to the other one of the opposing bag sides, said first and second profiles being adapted to interlock to close said bag; and a slider straddling said first and second fastener strips such that said slider is movable between a closed position and an open position, said slider including a separator leg disposed between said first and second profiles;

wherein said first and second profiles each includes an uppermost closure element, an intermediate closure element, and a bottommost closure element, with said bottommost closure element of said first profile including an L shape and said bottommost closure element of said second profile having a hook shape, wherein said bottommost closure elements contact along substantially their entire lengths when said slider is in the closed position.

6. A zippered bag according to claim 5, wherein said separator leg of said slider extends from the top surface of said slider between said uppermost and said intermediate closure elements, but does not contact said bottommost closure element, such that said bottommost closure elements contact along substantially their entire lengths even though said separator leg separates said upper and said intermediate closure elements along part of their lengths.

7. A zippered bag according to claim 5, wherein said uppermost and said intermediate closure elements each has a hook shape such that said uppermost and said intermediate closure elements interlock over substantially their entire lengths when said slider is in a closed position and the contact between said bottommost closure elements is an interlocking engagement over substantially the entire length of said bottommost closure elements.

8. A zippered bag according to claim 5, wherein said bottommost closure elements contact over a larger area than either pair of said uppermost and intermediate closure elements.

9. A zippered bag comprising two sheets sealed to each other along a plurality of edges to form opposing bag sides, said bag comprising:

a first fastener strip including a first profile including a closure element having a hook shape with an L-shaped distal end extending from the hook shape, said first fastener strip being attached to one of the opposing bag sides;

a second fastener strip including a second profile including a closure element having a hook shape, said second fastener strip being attached to the other one of the opposing bag sides, said closure element of said first profile and said closure element of said second profile being adapted to interlock to close said bag;

a slider straddling said first and second fastener strips such that said slider is movable between a closed position and an open position, said slider including a separator leg disposed between said first and second profiles adapted to separate said first and second profiles when said slider is moved from the closed position to the open position;

wherein the first profile and the second profile each further includes an upper closure element disposed above the L-shaped closure element and the closure element having a hook shape and wherein the L-shaped closure element and the closure element having a hook shape contact over a larger area than the upper closure elements.

10. A zippered bag according to claim 9, wherein said first profile and said second profile each further includes an uppermost closure element and an intermediate closure element, said closure element that has the L-shaped distal end is disposed below said uppermost and said intermediate closure elements, whereby said closure element that has the L-shaped distal end is a bottommost closure element, and wherein said closure element on said second profile that has a hook shape is disposed below said uppermost and said intermediate closure elements of said second profile, whereby said closure element on said second profile that has a hook shape is a bottommost closure element.

11. A zippered bag according to claim 10, wherein said separator leg of said slider extends from the top surface of said slider between said uppermost and said intermediate closure elements, but does not contact said bottommost closure elements when said slider is in the closed position, such that said bottommost closure elements contact along substantially their entire lengths even though said separator leg separates said upper and said intermediate closure elements along part of their lengths.

12. A zippered bag according to claim 9, wherein said slider includes side walls extending from the top and shoulders extending inwardly from said side walls, said side walls and said shoulders holding said slider onto said bag.

13. A zippered bag according to claim 9, wherein said first fastener strip comprises an inner wall and an outer wall, which extend substantially parallel to each other and are joined at a hinged portion disposed between them.

* * * * *